US008295505B2

(12) United States Patent
Weinans et al.

(10) Patent No.: US 8,295,505 B2
(45) Date of Patent: Oct. 23, 2012

(54) EARPHONE WITH CONTROLLABLE LEAKAGE OF SURROUNDING SOUND AND DEVICE THEREFOR

(75) Inventors: Erwin Weinans, Klijndik (NL); Rene Hin, Emmen (NL); Johan Schreuder, Dorpsstraat (NL); Gerjo Sampimon, Erm (NL)

(73) Assignee: Sony Ericsson Mobile Communications AB, Lund (SE)

( * ) Notice: Subject to any disclaimer, the term of this patent is extended or adjusted under 35 U.S.C. 154(b) by 960 days.

(21) Appl. No.: 11/307,255

(22) Filed: Jan. 30, 2006

(65) Prior Publication Data

US 2007/0177753 A1 Aug. 2, 2007

(51) Int. Cl.
*H04R 1/10* (2006.01)

(52) U.S. Cl. ..... 381/74; 381/72; 381/73.1; 381/328; 381/322

(58) Field of Classification Search ..... 381/373, 381/71.6, 322, 324, 328, 329, 330, 72, 74, 381/80, 81, 85, 334, 101, 123, 23.1, 309, 381/56, 58, 64, 314, 371, 380, 376, 73.1; 455/569.1, 575.2; 376/430

See application file for complete search history.

(56) References Cited

U.S. PATENT DOCUMENTS

| | | | | |
|---|---|---|---|---|
| 4,529,057 | A * | 7/1985 | Telford | 181/129 |
| 5,890,074 | A * | 3/1999 | Rydbeck et al. | 455/558 |
| 6,075,308 | A * | 6/2000 | Date | 310/314 |
| 6,332,027 | B1 * | 12/2001 | Guilloud et al. | 381/71.1 |
| 6,412,593 | B1 * | 7/2002 | Jones | 181/129 |
| 6,549,635 | B1 * | 4/2003 | Gebert | 381/324 |
| 7,570,772 | B2 * | 8/2009 | Sorensen et al. | 381/175 |
| 7,689,248 | B2 * | 3/2010 | Valve et al. | 455/556.1 |
| 2005/0105755 | A1 * | 5/2005 | Yueh | 381/371 |
| 2005/0143139 | A1 * | 6/2005 | Park et al. | 455/567 |
| 2006/0152108 | A1 | 7/2006 | Kodama et al. | |

FOREIGN PATENT DOCUMENTS

| | | |
|---|---|---|
| EP | 1578168 | 9/2005 |
| EP | 1 657 708 | 5/2006 |
| JP | 62-181090 | 11/1987 |
| JP | 3-90589 | 9/1991 |
| JP | 3-117995 | 12/1991 |
| JP | 7-42295 | 7/1995 |
| JP | 2005-191663 | 7/2005 |
| JP | 2005-223553 | 8/2005 |
| WO | 2004/098238 | 11/2004 |
| WO | 2004/107313 | 12/2004 |

* cited by examiner

OTHER PUBLICATIONS

Japanese Office Action for corresponding Japanese Application No. 2008-551671, dated Sep. 22, 2010.

*Primary Examiner* — Xu Mei
*Assistant Examiner* — Leshui Zhang
(74) *Attorney, Agent, or Firm* — Renner, Otto, Boisselle & Sklar LLP

(57) ABSTRACT

The invention relates to an earphone (1) with leakage control, which can be switched between states with and without leakage to adapt the earphone to different listening situations. The leakage of the earphone may be enabled and disabled automatically in dependence of the sound source and/or may be controlled manually by the user. The earphone is connectable to a device and comprises: a housing (2) substantially covering the external auditory meatus, and accommodating a loudspeaker element (3); the housing further comprising a channel (4) extending between an inner end (5) facing the external auditory meatus, and an outer end (6) facing the environment; and closure means (7) being switchable between a closed state in which said channel is substantially closed, and an open state in which said channel is admitting sound from the environment. The invention also relates to a device co-operating therewith, such as a mobile telephone.

15 Claims, 1 Drawing Sheet

EARPHONE WITH CONTROLLABLE LEAKAGE OF SURROUNDING SOUND AND DEVICE THEREFOR

FIELD OF THE INVENTION

The present invention relates to an earphone with leakage control, which can be switched between states with and without leakage to adapt the earphone to different listening situations. The invention also relates to a device co-operating therewith, such as a mobile telephone.

STATE OF THE ART

Earphones are commonly used today e.g. together with mobile telephones and audio players. One type of earphone, that is often referred to as an earbud, is a small speaker-like device that is designed to fit within the outer ear of a user so that he can listen to sound being transmitted from a sound source. When properly positioned in the ear, the earphone can provide the listener with sound transmission directly to the ear canal, the external auditory meatus. The earphone enables the user to listen more closely and avoids holding the device to the ear in case of a telephone.

The earphone blocks out external sounds and surrounding noise to a varying extent. In some situation blocking is desired, typically listening to music or because the surrounding noise is disturbing the listener. In other situations there needs to be some leakage of surrounding noise, typically to enable a good voice audio quality when speaking on a phone, and when the user wants to hear the surrounding noise, e.g. in a traffic situation.

Today's earphones are static, i.e. either the earphone permits some leakage or not.

SUMMARY OF THE INVENTION

An object of the present invention is to provide an earphone with controllable leakage. The leakage of the earphone may be enabled and disabled automatically in dependence of the sound source and/or may be controlled manually by the user.

In a first aspect, the invention provides an earphone connectable to a device and comprising:

a housing being shaped and configured to substantially cover the external auditory meatus when the earphone is worn, and accommodating a loudspeaker element directed to emit sound into the external auditory meatus; the housing further comprising a channel extending between an inner end disposed to face the external auditory meatus when the earphone is worn, and an outer end disposed to face the environment when the earphone is worn; and closure means being switchable between a closed state in which said channel is substantially closed, and an open state in which said channel is open to admit sound from the environment.

In one embodiment, the closure means is connected to an actuator for switching the closure means between its states in dependence of control signals received from the device.

In a further embodiment, the closure means comprises a slidable cover at the outer end of the channel.

The cover may comprise an actuating part to be engaged manually for switching the cover between its states.

Suitably, the cover is connected to an actuator for switching the cover between its states in dependence of control signals received from the device.

In a further embodiment, the closure means comprises a controllable membrane.

Suitably, the membrane is connected to an actuator for switching the membrane between its states in dependence of control signals received from the device.

The actuator may be arranged to control a bias voltage applied on the membrane.

In a second aspect, the invention provides a device comprising:

a user interface for entering commands from a user;

an audio player;

a telephone phone part; and a control unit;

the device being adapted to cooperate with an earphone having a closed state and an open state in which states the earphone is closed and opened, respectively, to sound from the environment, the earphone being switchable by means of an actuator for switching between the open and closed states, wherein the control unit is adapted to control the actuator.

In one embodiment, the control unit is adapted to control the actuator automatically in dependence of an operation mode of the device.

The control unit may be adapted to switch the earphone automatically to an open state when the device is in a telephone operation mode, and adapted to switch the earphone to a closed state when the device is in an audio player operation mode.

Also, the control unit may be adapted to switch the earphone in dependence of commands from a user entered through the user interface.

Suitably, the control unit is adapted to switch the earphone in dependence of commands from a user entered through the user interface, said commands overriding the automatic switching.

The device may be a portable telephone, a communicator, or a smart phone.

BRIEF DESCRIPTION OF THE DRAWINGS

The invention will be described in detail below with reference to the attached drawings, in which.

DETAILED DESCRIPTION OF PREFERRED EMBODIMENTS

The invention will be described in the context of mobile telephones and similar devices, such as communicators and smart phones. As is known, a mobile telephone may be used with an earphone to improve the hearing and freeing the hands for driving etc. Also, modern telephones often incorporate players for audio and video. Then stereo earphones are normally used, i.e. one earphone each for the left and the right ear.

Figure 1:
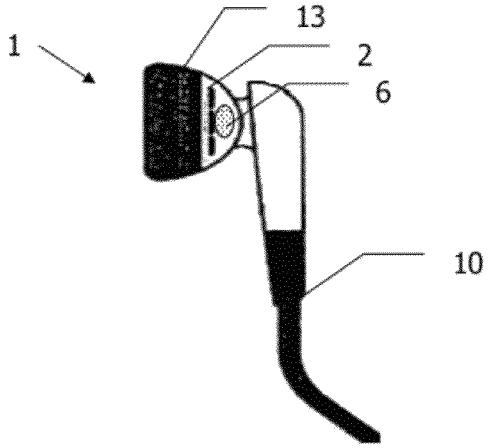
FIG. 1 is a side view of an earphone according to the invention.

A typical earphone model is shown in FIG. 1. The earphone 1 has a part fitting as a plug in the outer ear of a listener. For comfort, the earphone has a padding 13 so that the earphone may rest in the outer ear in close contact with the ear canal, the external auditory meatus. In this position the earphone 1 more or less seals off the ear canal. The earphone is connected by means of a cord 10 to a sound source, such as the device described below with reference to FIG. 3. The connection to the device may also be by means of short range radio communication (Bluetooth®) etc.

For best audio quality when listening to music and other audio sources no leakage of surrounding sound is desired. On the other hand, when using the connected device as a telephone and in other situations, leakage may be preferred.

Figure 2A:
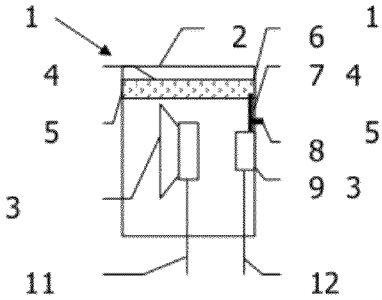
FIGS. 2A and 2B are schematic views of an earphone according to the invention in an open and closed state, respectively.
Figure 2B:
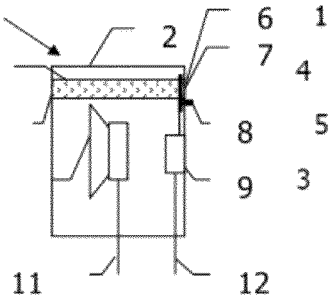

FIGS. 2A and 2B illustrate schematically an embodiment of an earphone according to the invention. The earphone 1 comprises a housing 2 to accommodating the loudspeaker element 3. The housing has openings (not shown) letting sound pass from the loudspeaker element 3 into the ear of the user.

The housing has a channel 4, which is open at one end 5 towards the ear and has an opening with closure means at the other end 6 toward the surrounding atmosphere. The channel may be shaped in various ways. Generally, it is a space within the housing 2 communicating sounds from a position directed towards the surrounding air and another position directed towards the ear.

A closure means is arranged at the outer end 6 of the channel 4. As is shown, the closure means may be a slidable cover 7. In FIG. 2A the cover 7 is open. In FIG. 2B the cover 7 is closed. The cover may be provided with a pin 8 or other actuating part which the user may move manually with his fingernail.

In another embodiment the cover 7 is connected to an actuator 9, which is capable of switching the cover between open and closed positions. The actuator may be an electric motor or relay, receiving control signals from the connected device through a control signal line 12.

The loudspeaker 3 is connected through audio signal lines 11 to the sound source. Suitably, the audio signal lines and the control signal line are collected in the cord 10.

Figure 2C:
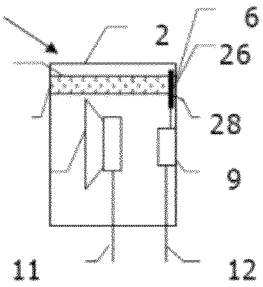
FIG. 2C is a schematic view of an earphone according to the invention.

In a further embodiment (FIG. 2C) the closure means is a membrane 26 covering the channel at the outer end. The membrane is connected to a switch 28 for switching the membrane between two states in which it has different acoustical characteristics. For example, the membrane may be biased to a higher tension in which it is not letting any sound pass in one state, and relaxed in another state letting sound pass like an open channel. The membrane can be controlled with a bias voltage passing through a coil. This bias voltage could be the same voltage which is used for a microphone as in a portable handsfree construction. When the phone is in telephone mode it activates its bias voltage automatically as is conventional in a telephone. This will give the user the possible to switch from close to open mode when there is an active call.

Figure 3:
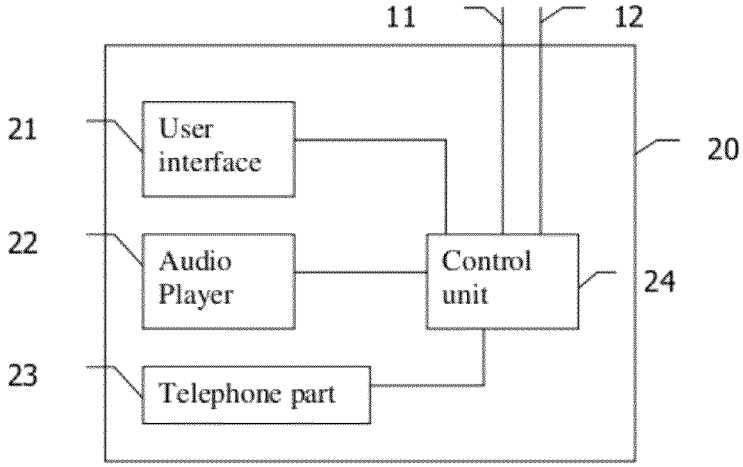
FIG. 3 is a schematic view of a device connectable to an earphone according to the invention.

FIG. 3 illustrates schematically a device suitable for use with an earphone according to the invention. In one embodiment the device comprises a user interface 21, such as a keypad with a joystick and/or voice control, an audio player 22 for playing MP3 files or other audio and video files, a telephone part 23 handling the radio interface etc of the telephone functions and a control unit 24 receiving commands from the user interface 21 and performing processing and switching of signals relating to various operations of the device.

Some typical operational cases are explained below. When listening to music, the user would normally prefer not to hear any noise from the surroundings. Thus, the channel 4 should be closed. First the user operates a device 20 to select an audio player mode and a desired music track. The control unit 24 then senses the operation mode and automatically switches the closure means 7 to the closed state by issuing suitable control signals to the actuator 9. In another embodiment, the user has to close the closure means himself manually.

In a telephone mode, the audio quality on the other hand is best with leakage. When the user places or receives a call, the control unit 24 senses the operation mode and automatically switches the closure means 7 to the open state by sending suitable control signals to the actuator, and activates the bias voltage of the membrane automatically as the case may be. In another embodiment, the user has to open the closure means himself manually.

On the other hand, in some situations the user may want to override the automatic control or preset the device 20 in accordance with his own preferences. For example, the user may want to listen to music with the earphone in the open state in order to be able to hear what is going on in the surroundings. Also, the user may want to talk on the phone with the earphone in a closed state when he is having a conversation in a noisy environment. Then, the user may preset the device 20 to always keep the channel open or closed in all situations, or may present the device to switch the earphone to closed state when speaking on the phone and to the open state when listening to music, or vice versa.

The inventions may be implemented by suitable combinations of software and hardware as is known in the art. Changes may be made in details, particularly in matters of shape, size and arrangement without exceeding the scope of the invention. The scope of the invention is only limited by the attached claims.

What is claimed is:

1. An earphone for being connectable to a mobile communication device comprising a sound source and said earphone comprising:

a connection device for connection to the sound source;

a housing being shaped and configured to cover an external auditory meatus of a user when the earphone is worn, and for accommodating a loudspeaker element configured to direct emitted sound into the external auditory meatus and being connected to the sound source through audio signal lines;

the housing further comprising a channel extending between an inner end facing the external auditory meatus when the earphone is worn, and an outer end facing a surrounding atmosphere when the earphone is worn; and closure means arranged for being switched between a closed state in which said channel is closed, and an open state in which said channel is open to admit sound from the surrounding atmosphere;

wherein said closure means is positioned at the outer end of the channel and further comprising a controllable membrane covering the opening at the outer end of the channel and further said controllable membrane is connected to a switch for switching said controllable membrane between two states in which the controllable membrane has different acoustical characteristics in dependence of control signals received from said mobile communication device.

2. An earphone according to claim 1, wherein the controllable membrane is controlled by a bias voltage.

3. An earphone according to claim 2, wherein the bias voltage is the same voltage which is used for a microphone in said mobile communication device.

4. An earphone according to claim 1, wherein the connection device is a cable.

5. An earphone according to claim 1, wherein the connection device is a radio transceiver.

6. A mobile communication device in combination with an earphone, the mobile communication device comprising:

a user interface for entering commands from a user;

an audio player;

a telephone phone part; and a control unit;

wherein the mobile communication device includes a telephone operation mode and an audio player operation mode;

wherein the earphone has a closed state and an open state in which states the earphone is closed and opened, respectively, to sound from a surrounding atmosphere, the earphone being switchable by means of an actuator for switching between the open and closed states; and wherein the control unit is configured to control the actuator for switching the earphone automatically to any one of the open or closed states when the mobile communication device is in the telephone operation mode, and for switching the earphone to any one of the open or closed state when the mobile communication device is in the audio player operation mode;

wherein the earphone has a closure means arranged for being switched between closed and opened states corresponding to the closed and open states of the earphone, wherein said closure means comprises a controllable membrane; and wherein the controllable membrane is switchable to provide different states in which the controllable membrane has different acoustical characteristics in dependence of control signals received from said mobile communication device.

7. The combination according to claim 6, wherein the control unit is configured to switch the earphone automatically to an open state when the device is in a telephone operation mode, and configured to automatically switch the earphone to a closed state when the device is in an audio player operation mode.

8. The combination according to claim 6, wherein the control unit is configured to control the actuator in dependence of commands from a user entered through the user interface.

9. The combination according to claim 6, wherein the control unit is configured to switch the earphone in dependence of commands from a user entered through the user interface, said commands overriding the automatic control of the actuator.

10. The combination according to claim 6, wherein the mobile communication device is a portable telephone, a communicator, or a smart phone.

11. The combination according to claim 6, wherein the earphone has a closure means switchable between open and closed states, and wherein the control unit is configured to sense the operation mode of the telephone phone part and automatically switch the closure means in response to the sensed operation mode.

12. The combination according to claim 6, wherein the earphone has a closure means switchable between open and closed states, and wherein the control unit is configured to sense the operation mode of the audio player and automatically switch the closure means in response to the sensed operation mode.

13. The combination according to claim 6, wherein the controllable membrane is connected to a switch for switching said controllable membrane between two states in which the controllable membrane has different acoustical characteristics in dependence of control signals received from said mobile communication device.

14. The combination according to claim 6, wherein the device is preset to always keep the earphone in the open state or the closed state in the telephone operation mode and/or audio player operation mode.

15. The combination according to claim 6, wherein the earphone is an earbud.

* * * * *

UNITED STATES PATENT AND TRADEMARK OFFICE

CERTIFICATE OF CORRECTION

PATENT NO. : 8,295,505 B2
APPLICATION NO. : 11/307255
DATED : October 23, 2012
INVENTOR(S) : Weinans et al.

It is certified that error appears in the above-identified patent and that said Letters Patent is hereby corrected as shown below:

Title page, item 75 incorrectly reads: Erwin Weinans, Klijndik (NL); Rene Hin, Emmen (NL); Johan Schreuder, Dorpsstraat (NL); Gerjo Sampimon, Erm (NL)

Item 75 is corrected to read: Erwin Weinans, Klijndik (NL); Rene Hin, Emmen (NL); Johan Schreuder, Ees (NL); Gerjo Sampimon, Erm (NL)

Signed and Sealed this
First Day of January, 2013

David J. Kappos

David J. Kappos
*Director of the United States Patent and Trademark Office*